US006647861B1

(12) United States Patent
Jacobi et al.

(10) Patent No.: US 6,647,861 B1
(45) Date of Patent: Nov. 18, 2003

(54) COOLED PISTON FOR INTERNAL COMBUSTION ENGINES

(75) Inventors: Detlef Jacobi, Waiblingen (DE); Rolf Wellandt, Messstetten (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/009,414

(22) PCT Filed: May 5, 2000

(86) PCT No.: PCT/DE00/01456

§ 371 (c)(1),
(2), (4) Date: Dec. 10, 2001

(87) PCT Pub. No.: WO00/77377

PCT Pub. Date: Dec. 21, 2000

(30) Foreign Application Priority Data

Jun. 11, 1999 (DE) ..... 199 26 567

(51) Int. Cl.[7] ..... F01B 31/08
(52) U.S. Cl. ..... 92/186
(58) Field of Search ..... 92/186

(56) References Cited

U.S. PATENT DOCUMENTS 3,336,844 A * 8/1967 Cornet ..... 92/186
4,986,167 A 1/1991 Stratton et al.
5,778,533 A * 7/1998 Kemnitz ..... 92/186
6,401,595 B1 * 6/2002 Bochart ..... 92/186

FOREIGN PATENT DOCUMENTS

| | | |
|---|---|---|
| DE | 252 638 | 12/1987 |
| DE | 39 91 677 | 8/1989 |
| DE | 41 34 530 | 5/1992 |
| DE | 40 39 754 | 6/1992 |
| DE | 42 08 037 | 9/1993 |
| WO | 92/10659 | 6/1992 |

* cited by examiner

*Primary Examiner*—Edward K. Look
*Assistant Examiner*—Michael Leslie
(74) *Attorney, Agent, or Firm*—Collard & Roe, P.C.

(57) ABSTRACT

The invention relates to a cooled piston for internal combustion engines. The inventive piston is provided with an annular cooling channel on the periphery of the piston head. Said cooling channel, at its end that is open towards the piston shaft, is closed by a correspondingly shaped wall part that is radially split at least once. The aim of the invention is to improve the supply of cooling oil in the cooling channel. To this end, the wall part at the end allocated to the split is provided with a respective recess and with an upturned S-bend section that serves to deflect the cooling oil jet.

8 Claims, 2 Drawing Sheets

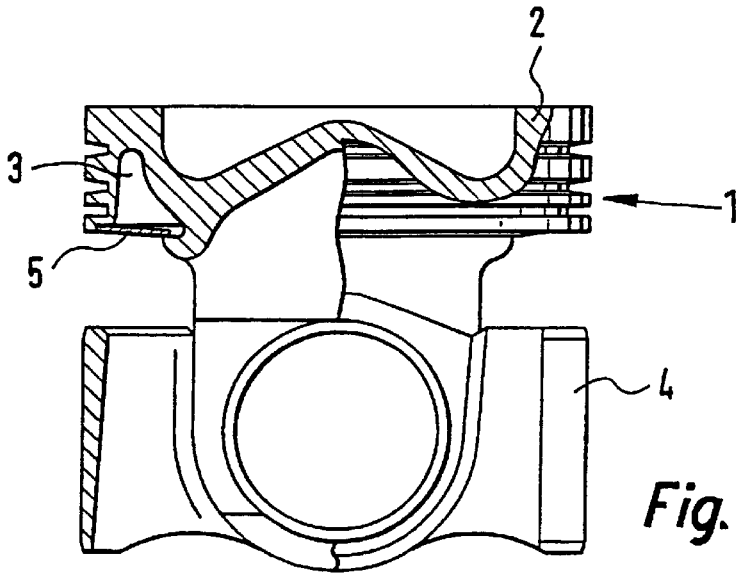
Fig. 1
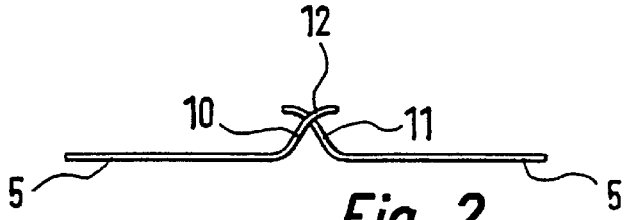
Fig. 2
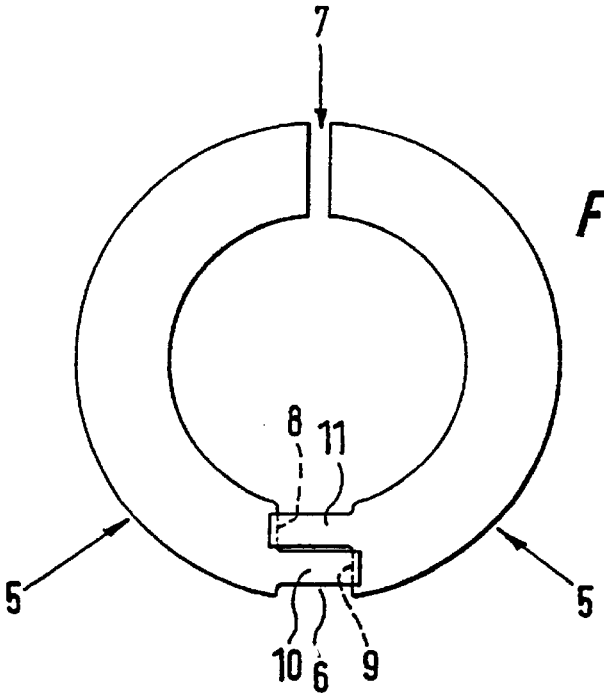
Fig. 3
Fig. 4
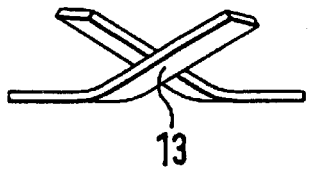

COOLED PISTON FOR INTERNAL COMBUSTION ENGINES

CROSS REFERENCE TO RELATED APPLICATIONS

Applicants claim priority under 35 U.S.C. §119 of German Application No. 199 26 567.4 filed Jun. 11, 1999. Applicants also claim priority under 35 U.S.C. §120 of PCT/DE00/01456 filed May 5, 2000. The international application under PCT article 21 (2) was not published in English.

The invention relates to a cooled piston for internal combustion engines with the features according to the introductory part of claim 1.

Such pistons are known from DD 252 638 A1 and DE 41 34 530 A1. In said pistons, the part of the wall serving for covering the downwardly open cooling channel extending all around in the form of a ring is realized in the form of an open sheet metal ring. Using the elastic deformation of said ring according to the Seeger ring principle, i.e. with initial tension in the radial direction, said sheet metal ring is disposed in a groove provided on the inner periphery of the piston ring zone, and the outer periphery of the wall of the combustion chamber.

A piston crown component is known from DE 42 08 037 C2, in connection with which the cooling channel, which is open at the bottom, is covered by a radially fixed, tensioned cup spring that is split at least two times along its periphery, and freely rests on supports radially located on the inside and outside on axially opposed sides.

A piston with a cooling channel in the piston crown is known from DE 39 91 677 T1 in connection with which provision is made for a baffle plate covering the lower open end of the cooling channel. The ends of said baffle are vertically bent off upwards in the zone of the split in order to maintain the cooling oil in the cooling channel at a defined level.

The above embodiments have the drawback that the feed of cooling oil to the cooling channel is not satisfactorily solved to the desired extent.

Therefore, the invention is based on the problem of improving the feed of the cooling oil in order to obtain a favorable degree of entrapment or filling of oil in the cooling channel.

Said problem is solved in a piston of the type specified above by the features according to the characterizing part of patent claim 1.

Other useful variations according to the invention are contained in the dependent claims.

The invention is explained in the following in greater detail with the help of the exemplified embodiments shown in the drawing, in which:

FIG. 1 is a side view of a piston shown by a partial section.

FIG. 2 is a side view of a wall part as defined by the invention.

FIG. 3 is a top view of the wall part according to FIG. 2.

FIG. 4 is a side view of the twisted ends of the wall part.

Figure 5:
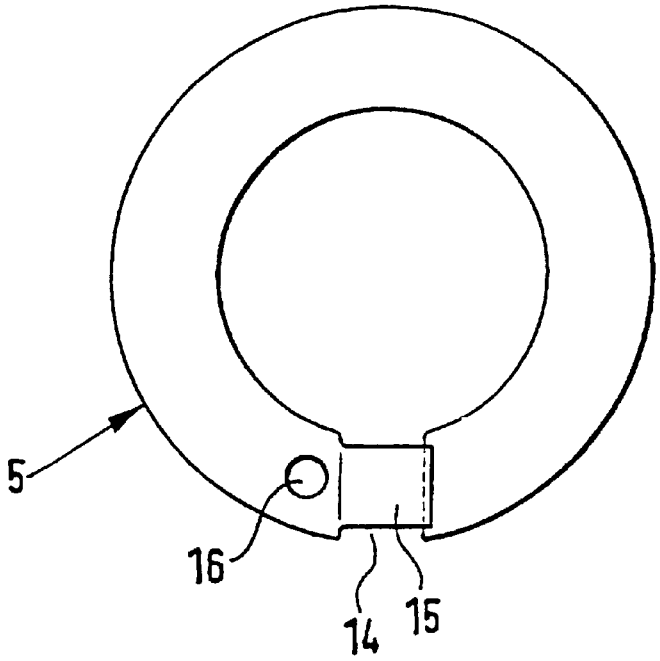
FIG. 5 is a top view of a second embodiment of the wall part.

A cooled piston 1 with a cooling channel 3 extending all around in the piston crown 2 in the form of a ring is closed at its end that is open toward the piston shaft 4 by a wall part 5, for example by a cup spring which is split twice. Within the zone of the oil feed, the wall part 5 is provided with a first radial split 6, and in the zone of the oil drain with a second radial split 7. At each of its ends associated with the split 6, said wall part 5 is provided on the one hand with a recess 8, 9 extending approximately across half of the radial width of the wall part 5. On the other hand, a part piece 10, 11 extending approximately over half of the radial width of the wall part 5 as well, is bent off upwards in the form of an "S" 12 in such a manner that good feed of the cooling oil into the cooling channel 3 is assured in order to obtain the desired degree of oil entrapment or filling.

A further improvement of the feed of cooling oil can then still be achieved by profiling the part pieces 10, 11, for example by a U-shaped form acting as a channel.

In another embodiment, in which the ends of the bent-off part pieces 10, 11 are provided with an additionally twisting 13, enhanced filling of the cooling channel, on the one hand, or additional impingement of oil upon the surrounding piston surfaces, on the other hand, can be achieved depending on the direction of the twisting.

According to an exemplified embodiment according to FIG. 5, the wall part 5, which is radially split once, is provided on its split 14 with an end piece 15 that is bent off in the form of an "SI" in an upwardly inclined manner for deflecting the jet of cooling oil on one side. A drain bore 16 is provided in the wall part 5 as the drain after about 360°.

Figure 6:
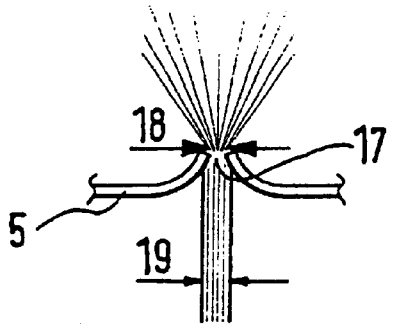
FIG. 6 is a side view of another embodiment of the feed opening of the wall part.
Figure 7:
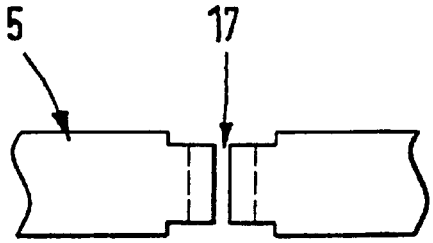
FIG. 7 is a top view according to FIG. 6.

According to another exemplified embodiment according to FIGS. 6 and 7, provision is made in the wall part 5 for an upwardly narrowing opening 17 for feeding the cooling oil. The gap width 18 of said opening is smaller than or equal to the diameter 19 of the oil jet supplied.

Enhanced feed of cooling oil into the cooling channel is obtained with such an embodiment in a simple manner in terms of construction.

What is claimed is:

1. A cooled piston for internal combustion engines with a cooling channel extending all around in the piston crown in the form of a ring, said cooling channel being closed at its end that is open toward the piston shaft, by a correspondingly shaped wall part that is secured on the piston and radially split at least once, characterized in that the wall part (5) has at least one part piece aligned inclined in relation to the cooling oil jet serving for deflecting the latter.

2. The cooled piston according to claim 1, characterized in that at each of its ends associated with the split (6), the wall part (5) has a recess (8, 9) and a part piece (10, 11) aligned inclined in relation to the cooling oil jet for deflecting the latter.

3. The cooled piston according to claim 2, characterized in that the bent-off part piece (10, 11) of the one end of the wall part (5) covers the recess (8, 9) of the other end of the wall part (5) in the zone of the split (6).

4. The cooled piston according to claim 1, characterized in that the bent-off part piece (10, 11) extends in about the form of an "S" (12).

5. The cooled piston according to claim 1, characterized in that the ends of the bent-off part pieces (10, 11) are twisted (13).

6. The cooled piston according to claim 1, characterized in that the bent-off part pieces (10, 11) are profiled, for example in the form a "U".

7. The cooled piston according to claim 1, characterized in that for feeding oil, provision is made in the wall part (5) for an upwardly narrowing opening (17) whose gap width (18) is smaller than or equal to the diameter (19) of the oil jet supplied.

8. The cooled piston according to claim 1, characterized in that a second split (7) for draining the oil is provided opposite the first split (6) of the wall part (5).

* * * * *